US005857280A

United States Patent [19]

Jewell

[11] Patent Number: 5,857,280

[45] Date of Patent: Jan. 12, 1999

[54] LOW PRESSURE TRIGGER PULL WITH COCKED POSITION SAFETY FOR A SEMIAUTOMATIC FIREARM

[76] Inventor: Arnold W. Jewell, 1490 Whitewater Rd., New Braunfels, Tex. 78132

[21] Appl. No.: 838,565

[22] Filed: Apr. 11, 1997

[51] Int. Cl.[6] ..... F41A 3/00

[52] U.S. Cl. ..... 42/69.03; 42/70.05

[58] Field of Search ..... 42/69.03, 70.08, 42/70.05; 89/139, 148, 27.12

[56] References Cited

U.S. PATENT DOCUMENTS

| | | | |
|---|---|---|---|
| 859,974 | 7/1907 | von Pocci | 42/69.03 |
| 3,167,877 | 2/1965 | Jüngeling | 42/69.03 |
| 4,017,996 | 4/1977 | Liedke | 42/69.03 |
| 4,056,038 | 11/1977 | Rath | 89/128 |
| 4,151,670 | 5/1979 | Rath | 42/69.03 |
| 5,086,579 | 2/1992 | Flatley et al. | 42/70.08 |
| 5,487,233 | 1/1996 | Jewell | 42/69.01 |
| 5,697,178 | 12/1997 | Haskell | 42/70.04 |
| 5,709,046 | 1/1998 | Canaday | 42/69.01 |
| 5,718,074 | 2/1998 | Keeney | 42/69.03 |

FOREIGN PATENT DOCUMENTS

| | | | |
|---|---|---|---|
| 119806 | 6/1948 | Australia | 89/148 |
| 411630 | 11/1966 | Switzerland | 89/139 |

*Primary Examiner*—Charles Jordan
*Assistant Examiner*—Christopher K. Montgomery
*Attorney, Agent, or Firm*—Joseph F. Long

[57] ABSTRACT

A trigger mechanism for a semiautomatic firearm whereby a spring loaded hammer strut acting through a lever system puts a light pressure to hold a sear in a locked position and whereby recoil after firing causes the sear to return to a locked position before release of firing pressure on a trigger through action of the lever system and a trigger reset system; a trigger pull spring acting to return said trigger reset system to firing position after pressure is released on the trigger.

5 Claims, 3 Drawing Sheets

LOW PRESSURE TRIGGER PULL WITH COCKED POSITION SAFETY FOR A SEMIAUTOMATIC FIREARM

BACKGROUND OF THE INVENTION

This invention relates to an improved trigger system for a semiautomatic firearm. Target shooters and those firearm users desiring great accuracy have shown a need for a trigger pull as light as a few ounces. To have a very light trigger pull the sear or catch that holds a hammer in a locked position must be operable with a small amount of pressure. This is achieved in this invention using a lever system powered by the hammer strut spring to put a small amount of pressure to hold the sear faces in a lock position with both sear faces moving essentially simultaneously when a trigger of the firearm is pressed. Recoil acts to reset the hammer side of the sear face through the lever system and to reset a resettable trigger assembly. A trigger disconnect lever in the resettable trigger assembly acts to reset the sear instantaneously to prevent continual firing when the trigger is in a depressed position and a trigger pull spring acts to pull the resettable trigger assembly to a firing position when the trigger is released.

A manually operable safety acts to move the sear faces to an open position and to lock the lever system in place to prevent operation of the firearm in either a cocked or uncocked position.

SUMMARY OF THE INVENTION

The invention may be summarized as an assembly to use in original manufacture or to retrofit an existing semiautomatic firearm to have a sear with low pressure holding the sear faces in a locked position to allow varying a trigger pull spring from a few ounces to several pounds of pressure. This assembly comprises a pivotally mounted spring loaded hammer with a striking face on a first end and a tang with a rounded side on a second end and with an extension on the side opposite the striking face of the hammer to activate a disconnect lever in a trigger assembly system. The tang with a flat side resting on a spring loaded pin powers a lever system to put minimum pressure on the hammer associated movable side of the sear and therefor minimum pressure on the movable trigger associated sear face. A trigger assembly essentially encompassed in a top opening in the pivotally mounted trigger has a disconnect lever that is recoil activated when struck by the extension on the hammer. When activated one end of the disconnect lever disconnects from an end of the trigger sear and a disconnect spring acts to reset the trigger side of the sear while the trigger is in the depressed position. At the same instant the trigger sear is resetting the recoil resets the tang and associated lever system to reset the hammer side of the sear. As the trigger is released pressure from the trigger pull spring compresses the disconnect lever spring to reconnect the end of the trigger sear with the disconnect lever to put the assembly in a fireable position. The invention further encompasses a manually operated safety that moves the sear to an open position and locks the lever system to prevent firing. This safety may be activated with the firearm in either a cocked or uncocked position.

DETAILED DESCRIPTION OF THE INVENTION

Figure 1:
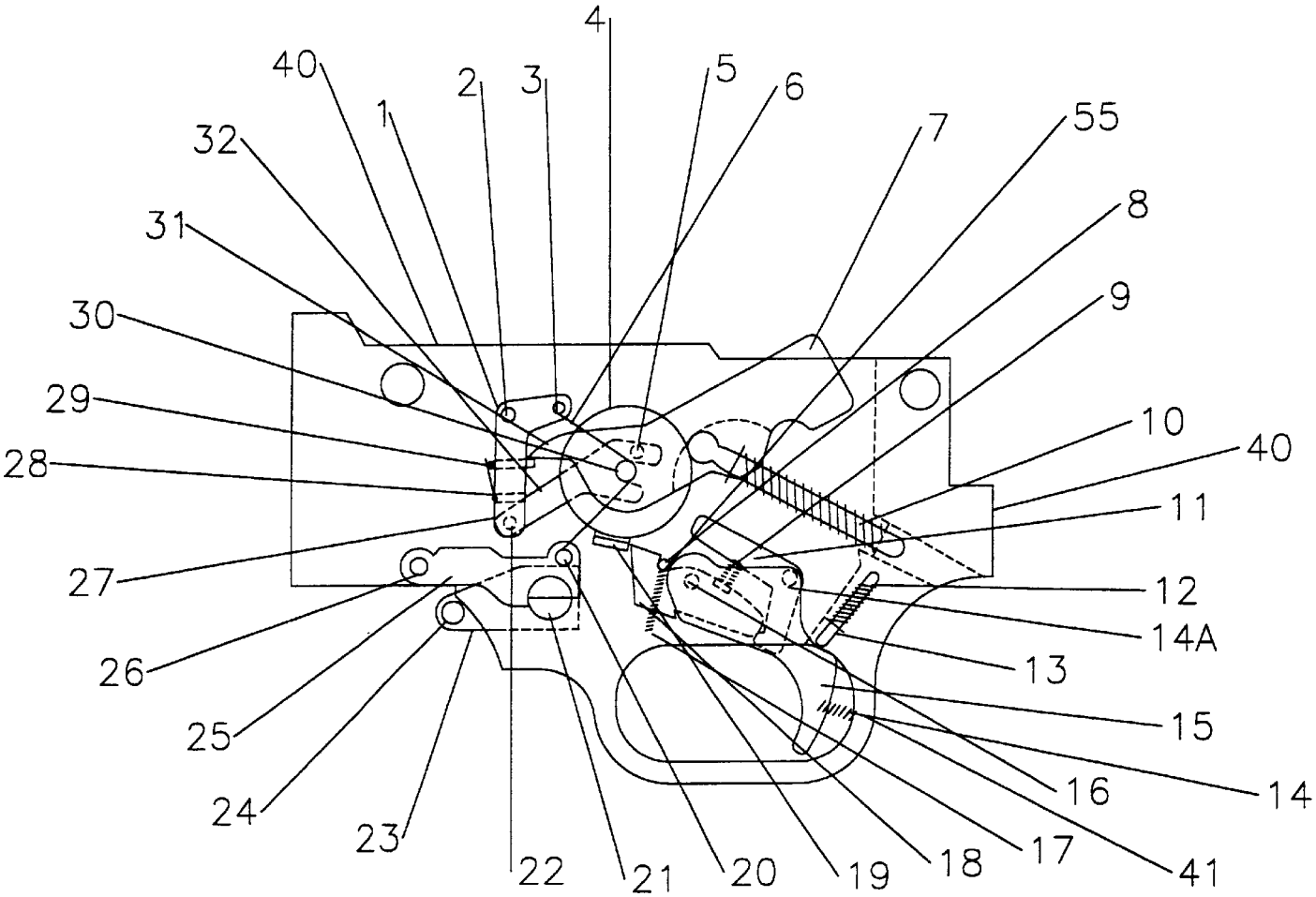
FIG. 1 shows the assembled unit with each part labeled.
Figure 2:
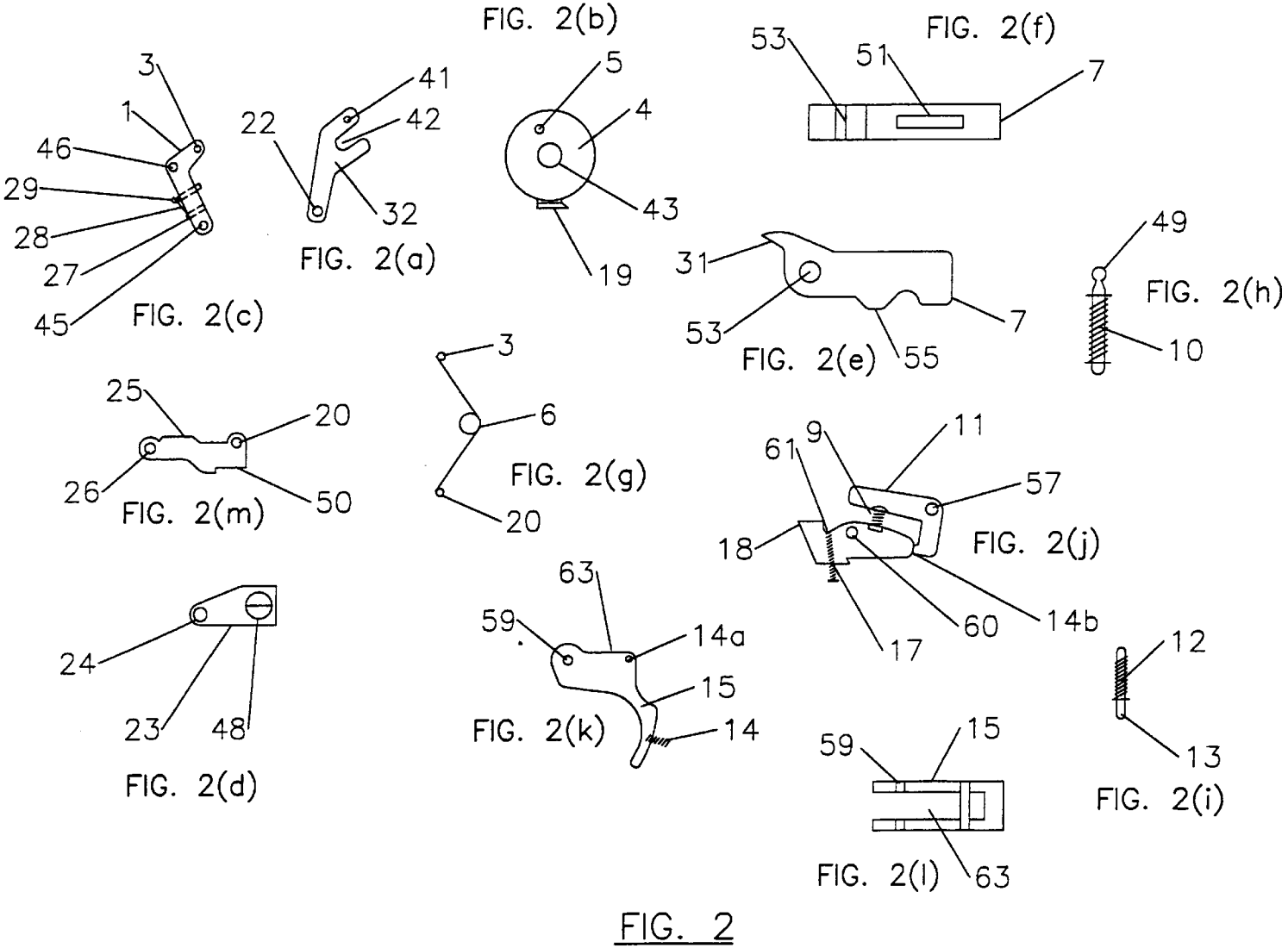
FIG. 2 shows individual parts.

The invention may best be described from the drawings. FIG. 1 shows a side view of the operating parts in the housing 40. FIG. 2 shows each individual piece or component to assemble the unit. Drawings of individual components are the shape as used in a working prototype of the invention. We will describe the individual components and their assembly from FIGS. 1 and 2 before describing the working of the assembly.

In FIG. 2(*a*), opening 42 of transfer link 32 is placed around hammer pin 30, FIG. 1

In FIG. 2(*b*) sear plate 4 is placed over transfer link 32 with hammer pin 30, FIG. 1 going through opening 43 with sear plate pin 5 pointing downward and engaging opening 41 in FIG. 2(*a*). Sear face or catch 19 protrudes upward from sear plate 4 to engage a sear face on trigger sear 18, FIG. 1. A sear is defined as the catch that holds the hammer of a gunlock at a cocked position.

Pin 22 in transfer link 32 goes through opening 45, FIG. 2(*c*) to engage support lever 1. Support lever pin 2, FIG. 1 engages the support lever 1 by placing support lever pin 2 through opening 46 in lever 1.

In FIG. 2(*d*) safety latch or activator 23 is placed over half round safety cam 21, FIG. 1 through opening 48. Knob 24 acts as an aid to activate safety latch 23.

Hammer 7 in FIG. 2(*e*) is engaged with hammer pivot pin 30, FIG. 1 through opening 53 in hammer 7.

Next in the assembly safety lever 25, FIG. 2(*m*) is placed as shown in FIG. 1 with safety pivot pin 26 going through opening 45. A lower support spring pin 20 projects upward from safety lever 25. Face 50 rests against safety cam 21, FIG. 1.

Next in the assembly reset spring 6 as shown in FIG. 2(*g*) is installed to press against upper spring support pin 3 and lower support spring pin 20 as shown in FIG. 1. Both support pin 3 and support pin 20 may have retaining slots or heads to hold spring 6 in place after installation.

FIG. 2(*f*) shows a bottom view of hammer 7. Slot 51 is configured to receive the main hammer spring strut 49, FIG. 2(*h*).

Hammer drive pin or strut 49 with a flat rounded head and spring drive 10 may be installed as shown in FIG. 1 with the head slipped into slot 51, FIG. 2(*f*), of hammer 7 with the back portion supported in housing 40.

Next trigger plunger 13 spring loaded with spring 12 that is depressable with a minimum of about six ounces of pressure in one embodiment, as shown in FIG. 2(*i*) is placed in housing 40 as shown in FIG. 1.

FIG. 2(*j*) shows an exploded view of disconnect lever 11 with opening 57 allowing insertion of pivot pin 14*a* as shown in FIG. 2(*k*) and trigger sear 18 with opening 61 to adjustably fit against stop pin 8, FIG. 1 using adjustment screw 17. Opening 60 allows installation on pivot pin 16 after pivot pin 16 is slipped into a first side of trigger 15, FIG. 2(*k*) through opening 59. Pivot pin 16 then goes through a second side of trigger 15 and fastens into housing 40. Compressible reset spring 9 may be inserted as shown with finger tip compression.

FIG. 2(*k*) shows a side view of trigger 15 which has a boxlike top structure FIG. 2(*l*) and has a stop screw or pin 14 to limit trigger travel; opening 59 to allow installation with pivot pin 16, FIG. 1 and top opening 63 to allow partial insertion of trigger sear 18 and pin 14*a* to allow pivotally installing disconnect lever 11 with disconnect spring 9.

FIG. 2(*l*) with opening 63 is shown to further elucidate the trigger structure. All other numbers are as previously described.

With assembly as described all components may be put in position as shown in FIG. 1. As shown recoil or operation of a bolt (not shown) has put the mechanism of the unit in a cocked position and ready to fire. With the safety in the off position as shown if the trigger 15 is pulled backward to depress spring 12 the hammer will rotate forward and fire the weapon. Note that for other embodiments we can vary pivot points, spring strength, geometry of the components and therefor their lever arm action to have a light or heavy pressure at the sear faces to allow a light trigger pull or a heavy trigger pull with varying geometry of the housing; thus various types of semiautomatic firearms may be retrofitted to secure the most desirable trigger pull for the user. Generally in the art a light trigger pull may be described as a trigger pull requiring from one ounce to four pounds pressure whereas a heavy trigger pull might be described as requiring three to ten pounds or more pressure.

Pulling of the trigger 15 causes it to rotate around pin 16 and against its spring 12 and plunger 13, thus rotating the trigger sear 18 to release hammer spring loaded sear surface 19 on sear plate 4. Through the connecting linkages, transfer link 32 and support lever 1, pin 29 is forced from its supporting position for hammer tang 31 when movement of the sear faces allows the hammer 7 to fire. The pulled trigger is restricted in its pulled position by screw 14. Immediately following clearance of hammer tang 31 below support lever pin 29 the reset spring 6 moves the linkage combination to its original position. Opening 42, FIG. 2(*a*) in transfer link 32 to pin 30, FIG. 1 prevents over movement of the linkage assembly.

Recoil after firing forces the bolt (not shown) rearward against the hammer 7 toward the re-cock position. After firing as the hammer tang 31 moves upward the rounded surface of the tang 31 pushes the pin 29 against its spring 28 which allows the hammer tang 31 to pass to the cocked position without changing the set position of the linkage combination. The pin spring 28 is secured to the support lever 1 by a rivet 27.

After firing recoil drives the hammer backwards and extension 55 on the hammer 7 strikes the end of disconnect lever 11 which rotates on its pivot pin 14*a* against its reset spring 9 and movement of disconnect latch 14*b*, FIG. 2(*j*), releases the trigger sear 18 to move upward against the tip of catch 14*b*. The reset spring 9 forces the trigger sear 18 to rotate about its pivot pin 16 to its stop 8 and puts sear face of trigger sear 18 in the lock position. As trigger 15 is allowed to move forward trigger pull spring 12 which is relatively stronger than disconnect spring 9 causes reconnection of the end of trigger sear 18 under latch 14*b* with the trigger sear face on sear 18 remaining in the lock position. The sear disconnect system as described is necessary to prevent automatic firing as long as the trigger is held in a depressed position.

As the bolt returns to the forward position, it releases the hammer 7 to come back to its cocked position, the tang 31 being supported again by pin 29, the load on which returns the linkage arrangement to the cocked position with sear face 19 against face 18. Release of pressure on the trigger 15 allows spring 12 and plunger 13 to return the trigger 15 to the cocked position. Screw 17 adjusts sear engagement by turning against stop 8 which rotates the trigger assembly around pin 16.

As discussed the safety comprises a safety lever 25, its pivot pin 26, a rotatable cam 21, its lever 23, and associated hardware. Rotation of the lever 23 to the safe position rotates cam 21 which incorporates a flat to receive the lower part of lever 25. Rotation of the cam 21 causes the lever 25 to rise as the cam 21 raises it to a high point. A shoulder on lever 25 engages the rounded end of support lever 1 rotating it around its pivot pin 2 and moving associated linkage to a point that moves the sear plate 4 and sear face 19 off the trigger sear 18 thus preventing movement of all associated parts and freeing the trigger assembly to rotate independently. With return of lever 23 to the fire position the safety lever 25 is held in the fire position by force of spring 6 on lower support spring pin 20.

Figure 3:
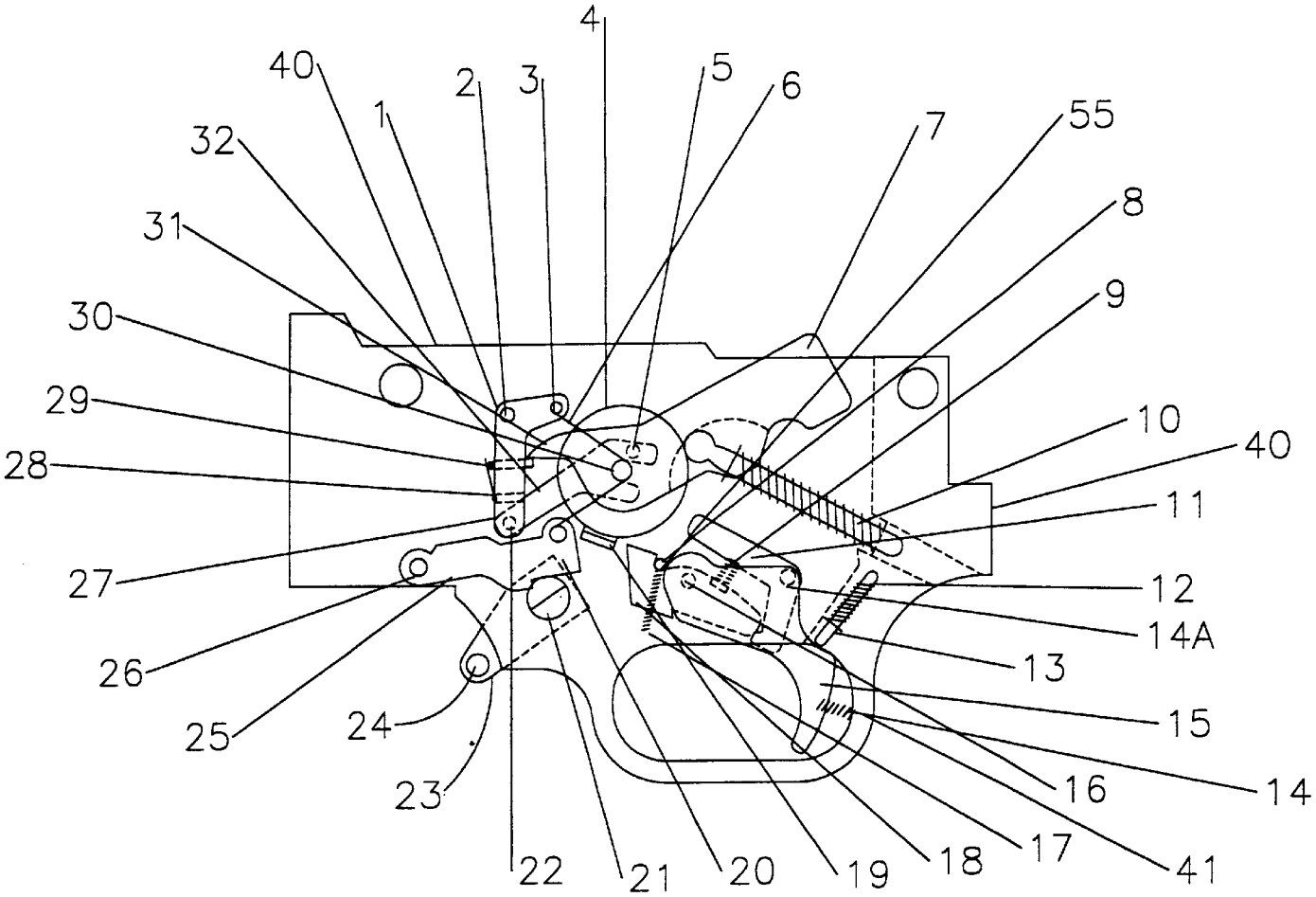
FIG. 3 shows the assembly unit with the safety mechanism in the lock position.

FIG. 3 differs from FIG. 1 in that the safety mechanism is shown in the safe or nonfireing position. In the safe position knob 24 is pulled downward thereby rotating the half round cam 21 that is a fixed part of lever 23 to cause cam 21 to rotate safety lever 25 upward on pivot pin 26 to push against transfer link 32 to rotate support lever 1 and, through transfer link 32 to rotate sear plate 4 to disconnect hammer spring loaded sear face 19 from trigger sear face 18. When knob 24 is pushed upward to a firing position tension on spring 6 urges lower support pin 20 downward to return the hammer spring loaded sear face 19 and trigger sear 18 to a contact position.

What is claimed is:

1. A trigger mechanism for a semiautomatic firearm comprising:

a) a housing, b) a spring loaded hammer with a striking face on a first end and with an extension on a lower side and a tang with a rounded side on a second end with said spring loaded hammer pivotally installed in said housing;

c) a trigger pivotally installed in said housing;

d) a spring loaded trigger plunger with a variable loading in said housing;

e) a sear comprised of a hammer spring loaded sear face pressing against a trigger sear face in a lock position in said housing;

f) a resettable hammer spring loaded lever means to cause said hammer spring loaded sear face to exert pressure against said trigger sear face in said housing; said resettable hammer spring loaded lever means comprises:

1) a hammer pin and a lever support pin, 2) a transfer link with a first open end and a round opening in one side of said open end and a lever connecting pin in a second end with said first open end pivotally contacting said hammer pin;

3) a flat round sear plate with a central round opening a sear plate pivot pin and an ell shaped extension to form said hammer spring loaded sear face; said sear plate being pivotally installed on said hammer pin with said sear plate pivot pin extending through said round opening in said transfer link;

4) an ell shaped support lever with an upper spring support pin on a first end, an opening to fit around said lever support pin in an angle of said ell, a spring loaded support pin, and an opening in a second end pivotally connected with said lever connecting pin in said transfer link and pivotally connected with said lever support pin in said housing;

5) a rounded tang on said hammer; said rounded tang resting on said spring loaded support pin in said ell shaped lever when said assembly is in a firing position; pressure on said spring loaded support pin being transmitted through said support lever, through said lever connecting pin to said transfer link, to said sear plate pivot pin, and said sear plate to said hammer spring loaded sear face;

g) a resettable trigger assembly means in said housing; said assembly being activatable on recoil by said extension on said hammer to reset said trigger sear face in a lock position after firing while said trigger is in a depressed position.

2. A trigger mechanism for a semiautomatic firearm as in claim 1 further comprising a manually operable safety means to disconnect said sear faces and lock said resettable hammer spring loaded lever means to prevent firing said firearm.

3. A trigger mechanism for a semiautomatic firearm as in claim 1 wherein said resettable trigger assembly means comprises:

1) a trigger sear pivotally installed in an upper slot in said trigger and extending forward of said trigger under a stop pin with adjustment means to adjust length of said trigger sear face contact with said hammer spring loaded sear face;

2) an ell shaped disconnect lever pivotally installed in a rearward end of said slot in said trigger;

3) a reset spring between said ell shaped disconnect lever and said trigger sear;

4) a catch on a rearward end of said disconnect lever that engages a rearward end of said trigger sear when said trigger is in a forward position; said catch being disengaged after firing when by recoil action said extension on said hammer strikes a forward end of said disconnect lever with said reset spring then acting to push said sear face to a locked position while said trigger is still in a depressed position and with said spring loaded trigger pull plunger acting to re-engage said rearward end of said trigger sear and said disconnect lever when pull pressure is released on said trigger.

4. A trigger mechanism for a semiautomatic firearm as in claim 2 wherein said manually operable safety means comprises:

1) a flat lever pivotally connected at a first end with a curved depression means in an upper face, 2) a rotatable half round cam mounted in said housing with a flat face of said cam contacting a lower face of said flat lever when said safety is in an off position;

3) a spring means operably connected to urge said flat lever to said off position;

4) a manually operable safety lever mounted to rotate said half round cam causing said curved depression means to move and lock a portion of said resettable hammer spring loaded lever means to disengage said sear when said lever is in an on position.

5. A trigger mechanism with a cock position safety for a semiautomatic firearm comprising:

a) a boxlike housing; said housing having a trigger guard attached, a top rectangular opening and a bottom rectangular opening;

b) a hammer pin, a lever support pin, a safety pivot pin, a half round safety cam, and a trigger pivot pin, each fastened in said housing;

c) a transfer link with a first open end and round opening in one side of said open end and a lever connecting pin in a second end pivotally connected with said first open end pivotally contacting said hammer pin;

d) a flat round sear plate with a central round opening, a sear plate pivot pin and an ell shaped extension to form a sear surface, pivotally installed on said hammer pivot pin with said sear plate pivot pin extending through said round opening in said transfer link;

e) an ell shaped support lever with an upper spring support pin on a first end, an opening to fit around said lever support pin in an angle of said ell, a spring loaded support pin, and an opening in a second end pivotally connected with said lever connecting pin in said transfer link and pivotally connected with said lever support pin in said housing;

f) a hammer with a striking face on a first end and a rounded tang on a second end connected with said hammer pivot pin; said hammer having a round bottom slot and an activator extension on a side opposite said striking face;

g) a spring loaded hammer drive pin with a rounded first end installed in said round bottom slot in said hammer and supported on a second end in said housing;

h) a safety lever pivotally installed on said safety pivot pin on a first end and with a second end having a lower spring support pin and with a bottom face of said lever resting against a flat face of said half round safety cam when said safety lever is in the off position;

i) a safety activating lever with manually operable knob protruding from said housing on a first end and connected on a second end to rotate said cam, j) a reset spring pivotally connected around said hammer pin with reset spring arms pushing against said upper spring support pin to urge said spring loaded support pin under said tang and pushing against said lower spring support pin to urge said safety lever against said safety cam;

k) a spring loaded trigger plunger installed in said housing;

l) a trigger assembly comprising a slotted rectangular shape with a curved extension; said slotted rectangular shape pivotally attached to said housing around said trigger pivot pin;

m) a trigger sear reset assembly means comprising a disconnect lever, a reset spring and a trigger sear operably attached in said slotted rectangular shape in said trigger assembly, said sear reset assembly acting to disengage said sear when said trigger is pulled to allow said hammer to fire said firearm and to reset to a cocked position when contacted by said activator extension on said hammer by force of recoil and when firing pressure on said trigger is released.

* * * * *